US007611448B2

(12) United States Patent
Schiff

(10) Patent No.: US 7,611,448 B2
(45) Date of Patent: Nov. 3, 2009

(54) ADJUSTABLE-WEIGHT EXERCISE APPARATUS AND METHOD

(76) Inventor: Jon D. Schiff, 4733 Vince Ct., St. Joseph, MI (US) 49085

( * ) Notice: Subject to any disclaimer, the term of this patent is extended or adjusted under 35 U.S.C. 154(b) by 175 days.

(21) Appl. No.: 11/934,243

(22) Filed: Nov. 2, 2007

(65) Prior Publication Data

US 2009/0118105 A1 May 7, 2009

(51) Int. Cl.
*A63B 21/072* (2006.01)
*A63B 21/075* (2006.01)

(52) U.S. Cl. ..... 482/107

(58) Field of Classification Search ..... 482/44, 482/50, 55, 92–94, 97–98, 104–109; 473/219, 473/226, 256; 403/326, 329; 24/591.1, 593.1, 24/701–702; *A63B 21/072, 21/075, 21/078*
See application file for complete search history.

(56) References Cited

U.S. PATENT DOCUMENTS 808,008 A * 12/1905 Cagle ..... 285/88
1,033,187 A * 7/1912 Metzger ..... 285/87
1,536,048 A * 5/1925 Alastalo ..... 482/108
1,645,457 A 10/1927 Schall
3,771,785 A 11/1973 Speyer
4,453,710 A 6/1984 Plotz
4,529,197 A 7/1985 Gogarty
4,585,367 A * 4/1986 Gall ..... 403/104
4,738,446 A 4/1988 Miles
4,787,629 A 11/1988 DeMyer
4,817,944 A 4/1989 Anderson et al.
4,955,603 A * 9/1990 Becker ..... 482/107
4,971,305 A 11/1990 Rennex
4,971,318 A 11/1990 Tracy
5,123,885 A 6/1992 Shields
5,163,887 A * 11/1992 Hatch ..... 482/107
5,344,375 A 9/1994 Cooper
5,346,449 A 9/1994 Schlagel
5,407,413 A 4/1995 Kupferman
5,435,800 A 7/1995 Nelson
5,464,379 A * 11/1995 Zarecky ..... 482/108
5,637,064 A 6/1997 Olson et al.
5,839,997 A 11/1998 Roth et al.
6,315,699 B1 * 11/2001 Romero ..... 482/107
6,971,974 B2 12/2005 Bowman et al.
7,025,713 B2 * 4/2006 Dalebout et al. ..... 482/107
7,037,245 B2 * 5/2006 Burwell ..... 482/108
7,087,000 B1 8/2006 Walker
7,137,931 B2 11/2006 Liu
7,172,536 B2 2/2007 Liu
7,182,716 B1 * 2/2007 Dawson ..... 482/108

* cited by examiner

*Primary Examiner*—Loan H Thanh
*Assistant Examiner*—Oren Ginsberg
(74) *Attorney, Agent, or Firm*—Price, Heneveld, Cooper, DeWitt & Litton LLP

(57) ABSTRACT

An adjustable-weight exercise apparatus include a rod with opposing end sections defining bearing surfaces, a first shallow channel without ribs, and a second shallow channel with ribs. The weights each include a hub shaped to telescopingly slide onto ends of the rod. Each hub further includes opposing flexible fingers with tips configured to slide along the second shallow channel when in a first rotational orientation during assembly of the weights onto the rod, and configured to flex over a raised detent into engagement with the second shallow channel between the ribs when the weight is rotated.

18 Claims, 2 Drawing Sheets

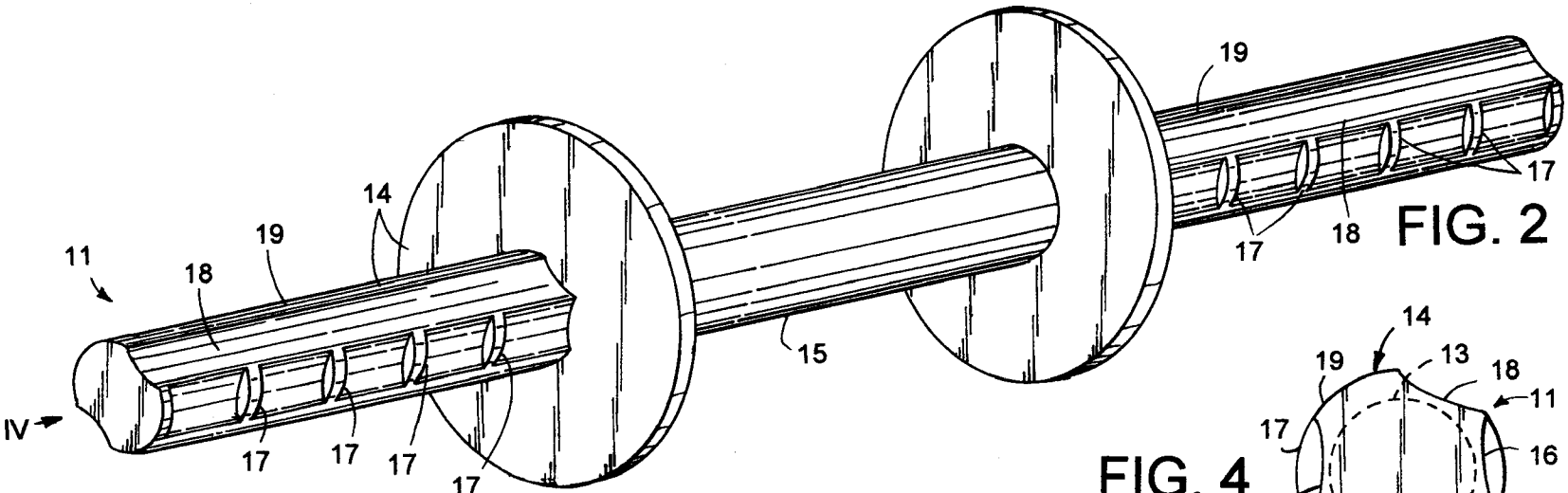
FIG. 2
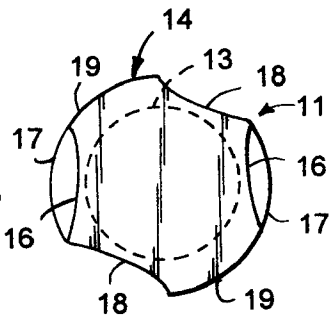
FIG. 4
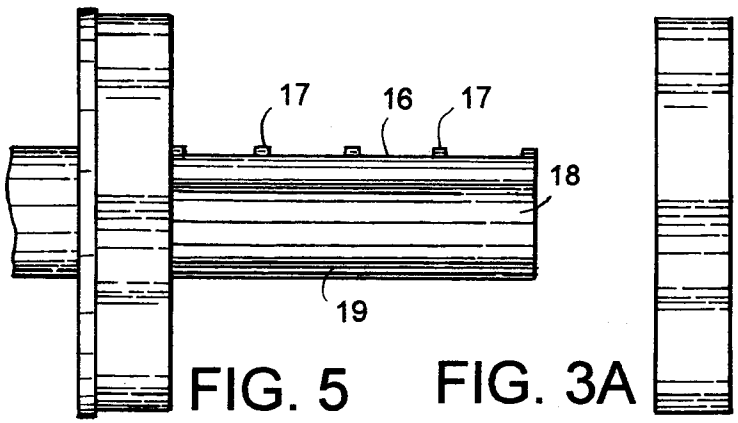
FIG. 5
FIG. 3A
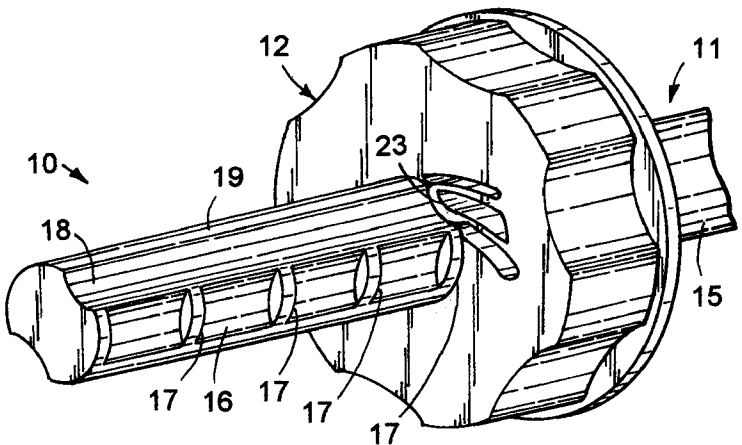
FIG. 1

ADJUSTABLE-WEIGHT EXERCISE APPARATUS AND METHOD

BACKGROUND

The present invention relates to an adjustable-weight exercise apparatus with weights having an integral resilient system for interlockingly engaging a bar handle upon rotation of the weights.

Adjustable-weight exercise equipment such as free weights and dumbbells are popular with people interested in physical fitness, since optimal weights can be selected for particular fitness programs and exercise routines. Typically, the equipment includes a bar (or handle), a plurality of weights attachable to the bar, and locking collars for locking the weights onto ends of the bar. However, often the collars are misplaced or are not located conveniently, causing an interruption to the exercise routine while one searches for the collars. Further, removing the collar to add weights takes up time, delays the workout, and can be inconvenient to the user. Still further, the collar takes up space at the ends of the bar, increasing material cost of the product and also wasting space at an end of the bar.

Some patents and products exist where the exercise equipment's collar is replaced with a selector that can be adjusted to select (or de-select) additional weights. However, these known systems are expensive, complex, and are subject to safety hazards from partial engagement of their selective interlock system. In particular, the structure of many of these known systems involves significant machining and/or forming of the rod, the weights, and/or a selector . . . all of which add considerably to expense. Further, systems that incorporate moving parts, such as a latch or selector pin or selector ribbon, are subject to warranty defects, damage and wear. Further, they often include multiple pieces, and often are not robust. Sometimes, they are not intuitively obvious to operate.

SUMMARY OF THE PRESENT INVENTION

In one aspect of the present invention, an adjustable-weight exercise apparatus includes a rod with opposing end sections each having a transverse cross section defining first, second, and third longitudinally-extending surfaces positioned circumferentially, and a detent between the second and third longitudinally-extending surfaces. The apparatus further includes a plurality of weights each having a hub defining a hole shaped to slide onto one of the opposing end sections. The hub includes a bearing surface for slidably engaging the first longitudinally-extending surface and includes at least one flexible finger with a tip configured to slide along the second longitudinally-extending surface when in a first rotational orientation during assembly of the weights onto one of the end sections of the rod. The finger is configured to flex over the detent and then interlockingly engage the third longitudinally-extending surface when the weight is rotated to thus lock the weights onto the rod.

In another aspect of the present invention, an apparatus includes a rod with a first surface defining a cylinder, a second surface defining an assembly-permitting shallow channel, and a third surface defining a weight-locking shallow channel with longitudinally spaced ridges. A plurality of weights is provided, each having a hub defining a hole shaped to slide onto ends of the rod. At least two of the weights include a bearing surface in their hub for slidably engaging the first surface and further include at least one flexible finger configured to slide along the second surface when in a first rotational orientation during assembly of the weights onto the rod, and configured to flex over the detent and then interlockingly engage the third surface when the weight is rotated.

In still another aspect of the present invention, an adjustable exercise apparatus includes a rod with ends each having a transverse cross section defining at least a first recessed surface and a detent adjacent the recessed surface. The apparatus includes a plurality of weights each designed to telescopingly slide onto one of the ends. The weights each including a hub with a bearing surface for slidably engaging one of the ends and further include at least one flexible finger configured to permit sliding assembly onto the ends when in a first rotational orientation, and configured to flex over the detent and then interlockingly engage the recessed surface when the weight is rotated.

In still another aspect of the present invention, an adjustable exercise apparatus comprises a rod, and a plurality of weights each configured to slide onto the rod when in a first rotational orientation and configured to interlockingly engage the rod when rotated to a second rotational orientation.

In still another aspect of the present invention, a method of exercising comprises steps of providing a rod and weights configured for self-attachment to the rod, assembling at least one weight onto each end of the rod, and securing the weights to the ends by rotating the weights on the rod from a first rotational orientation to an interlocking second rotational orientation.

These and other aspects, objects, and features of the present invention will be understood and appreciated by those skilled in the art upon studying the following specification, claims, and appended drawings.

BRIEF DESCRIPTION OF DRAWINGS

FIG. 1 is a fragmentary perspective view of an adjustable-weight exercise apparatus (shown as a dumbbell) including a rod and weights.

FIG. 2 is a perspective view of the rod/handle in FIG. 1.

FIGS. 3-3A are side and end views of the weights in FIG. 1.

FIG. 4 is an end view of the rod/handle in FIG. 2.

FIG. 5 is a fragmentary side view of an end section of the rod/handle in FIG. 2

DETAILED DESCRIPTION OF PREFERRED EMBODIMENTS

Figure 3:
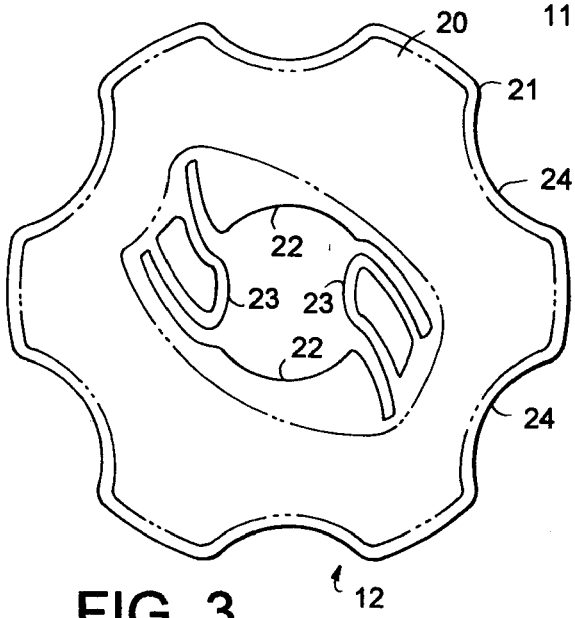

A dumbbell 10 (or any weighted exercise apparatus) includes a rod/handle 11 and a plurality of weights 12. The handle 11 (FIGS. 1-2 and 4-5) includes a metal bar or rod 13 with each end overmolded with an outer layer of material 14 (preferably nylon) to form a particularly shaped cross section. The cross section includes two concave longitudinally-extending locking surfaces 16 with ribs 17 spaced longitudinally, two adjacent concave longitudinally-extending surfaces 18 (without ribs), and two convex longitudinally-extending bearing surfaces 19. The weights 12 (FIGS. 1, 3 and 3A) include an internal metal plate 20 overmolded with a polymeric covering 21 such as acetal (Delrin®). The covering 21 forms a hub with a hole at a center of the plate 20. The hub includes opposing bearing surfaces 22 and a pair of opposing resilient fingers 23. The bearing surfaces 22 engage the bearing surfaces 19 on the handle 11 and permit weights 12 to be slid onto the bar when the fingers 23 are aligned with the concave surfaces 18. (See FIG. 3A.) Notably, a variety of different masses can be provided in the weights 12 by varying a mass of the plate 20.

Figure 6:
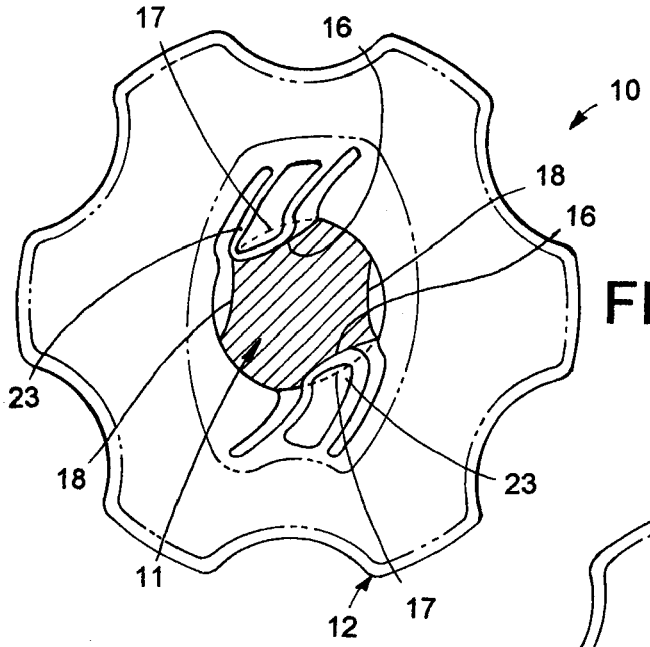
FIGS. 6-6A are end views of FIG. 1, FIG. 6 showing the weight in a locked rotational position, and FIG. 6A showing the weight rotated to an assembly-permitting rotational position.
Figure 6A:
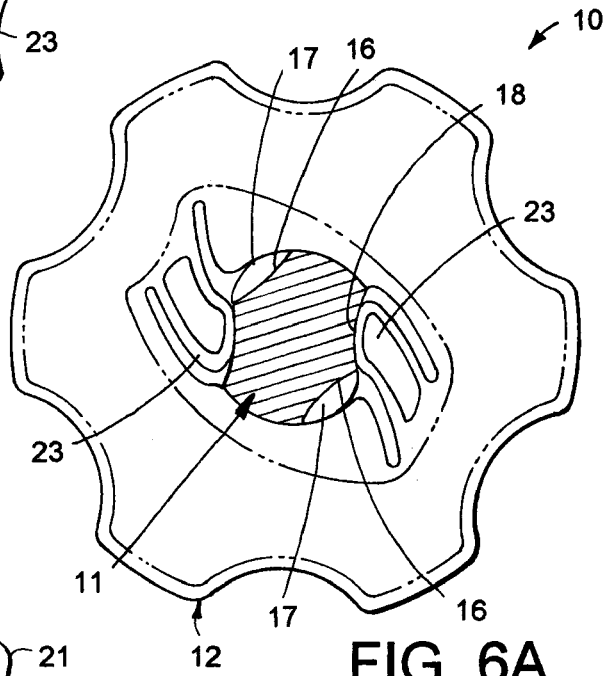

The weights 12 can be positioned on the ends of the handle 11 in an assembly-permitting first position (FIG. 6A) where the fingers 23 can slide longitudinally along the surface 18 onto the handle 11. The weights 12 include an undulating outer surface that can be grasped to rotate the weights 12 on the handle 11, so that the fingers 23 resiliently flex and rotate to engage the concave surfaces 16 between the ribs 17. (See FIG. 6.) In this rotational position, the weights 12 are locked onto the handle 11 because the fingers 23 fit between the ribs 17 and are retained axially by the ribs 17, and further the fingers 23 are retained rotationally by engagement with the concave surfaces 16. Preferably, the fingers 23 include a tip that is slightly rounded, and also the detent formed on the rod 13 between the surfaces 16 and 18 is raised and pointed, such that the fingers 23 tend to bias the weights 12 rotationally toward either an engaged/interlocked rotational position (FIG. 6), or toward the unlocked, assembly-permitting rotational position (FIG. 6A). The positive nature of this action gives the user a tell-tale positive signal that full engagement has been achieved when rotationally interlocking weights 12 onto the rod 13. Notably, the fingers 23 are slightly curved in shape and further the fingers 23 include a hollowed-out stem to facilitate flexing along their stem. The slot formed in the weights 12 around the border of the fingers 23 provides room for the fingers 23 to flex. One advantage of the present system is that a very positive feel is provided even with a relatively short movement of the fingers 23. It is noted that the illustrated fingers 23 are very durable, and further that the fingers 23 are in a protected position, such that the likelihood of damage to the fingers 23 is quite small.

The outer perimeter of each of the illustrated weights 12 includes depressions 24 to facilitate gripping and rotating the weights 12. However, it is contemplated that the weights 12 could include non-slip material or other shapes to facilitate gripping and rotation. The weights 12 can be made different sizes and with different heaviness. Advantageously, a shape of the weights 12 permits them to be assembled onto the rod 13 with either of their sides facing the rod 13 (i.e., the weights 12 are "non-handed"). Foam, rubber, or other convenient gripping material can be added to a center of the handle 11 for aesthetics, comfort, and user safety.

Advantages of the present arrangement include the fact that the dumbbell 10 is adjustable in weight, but does not require any separate locking collar(s). The weights 12 are not "handed" and will attach to either end of the handle 11 and can be assembled onto the handle 11 even if the weights 12 are inverted or "flipped". (i.e., The weights 12 are not right hand nor left hand, nor do they include an "inside" or "outside".) The system is very robust, long lasting, and durable. The fingers 23 (acetal) engage a surface (nylon) of the rod 13 in a way that is very positive. The fingers 23 basically prevent "partial" locking since their tips include a curved surface causing them to bias the weights 12 into either a rod-locked position or toward an assembly-permitting unlocked position. (Note that acetal and nylon have very low coefficient of friction, which gives a very positive feel letting the user know when the weights 12 have locked onto the rod 13.) The weights 12 can be attached out to an extreme end of the handle 11, making the system very compact. (i.e., There is no need to include an extra several inches on the end of the handle/bar, since there is no need for a locking collar.) The system is very inexpensive, and is semi-traditional since it includes only weights and a handle (and does not require a tray to hold the weights, nor does it require a selector mechanism to grip different weights).

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. An adjustable-weight exercise apparatus comprising:

a rod with opposing end sections each having a transverse cross section defining first, second, and third longitudinally-extending surfaces positioned circumferentially, and a detent between the second and third longitudinally-extending surfaces; and a plurality of weights each having a hub defining a hole shaped to slide onto one of the opposing end sections; the hub including a bearing surface for slidably engaging the first longitudinally-extending surface and including at least one flexible finger with a tip extending radially inward within the hole, the flexible finger configured to slide along the second longitudinally-extending surface when in a first rotational orientation during assembly of the weights onto one of the end sections of the rod, and configured to flex over the detent and then interlockingly engage the third longitudinally-extending surface when the weight is rotated to thus lock the weights onto the rod; and wherein the at least one finger includes opposing fingers extending in opposite directions, and wherein the first, second and third longitudinally-extending surfaces of the rod include first, second and third opposing surfaces.

2. The apparatus defined in claim 1, wherein the first longitudinally-extending surface defines a cylindrical shape.

3. The apparatus defined in claim 2, wherein the second and third longitudinally-extending surfaces lie within the cylindrical shape.

4. The apparatus defined in claim 3, wherein the second and third longitudinally-extending surfaces each define a concave channel extending along the rod.

5. The apparatus defined in claim 4, wherein the third longitudinally-extending surface includes spaced apart ridges and the tip of the finger is shaped to fit between the ridges.

6. The apparatus defined in claim 1, wherein the rod includes a handle located between the end sections, and includes a flange between each end of the handle and the associated end section.

7. The apparatus defined in claim 1, wherein the rod includes a metal bar, and further includes an overmolded polymeric portion defining the first, second, and third longitudinally-extending surfaces.

8. The apparatus defined in claim 1, wherein the weights each include a metal plate and further include an overmolded polymeric portion defining the finger.

9. The apparatus defined in claim 1, wherein the apparatus includes only the rod and weights, and does not include a locking collar.

10. The apparatus defined in claim 1, wherein the weights include different masses.

11. The apparatus defined in claim 1, wherein the weights each have an undulated outer surface for gripping and to assist with rotational engagement onto the rod.

12. The apparatus defined in claim 1, wherein the weights and the rod are overmolded with different materials having a low coefficient of friction therebetween.

13. The apparatus defined in claim 12, wherein the weights are overmolded with an acetal polymer.

14. The apparatus defined in claim 12, wherein the rod is overmolded with a nylon material.

15. The apparatus defined in claim 1, wherein the at least one finger tip has a rounded surface configured to bias the weight rotationally off of the detent toward an assembly position where the finger engages the second longitudinally-extending surface or toward a locked position where the finger engages the third longitudinally-extending surface.

16. The apparatus defined in claim 1, wherein the at least one flexible finger includes a resiliently flexible root that connects the tip to the hub.

17. The apparatus defined in claim 16, wherein the root extends at an angle to a radial direction defined by the rod.

18. The apparatus defined in claim 1, wherein the weights are non-handed and are configured to fit onto the rod with either side of the weight positioned toward the rod.

* * * * *